US011492829B1

(12) United States Patent
Edwards

(10) Patent No.: US 11,492,829 B1
(45) **Date of Patent: *Nov. 8, 2022**

(54) DOOR SECURITY DEVICE

(71) Applicant: Ellington Edwards, Washington, DC (US)

(72) Inventor: Ellington Edwards, Washington, DC (US)

( * ) Notice: Subject to any disclaimer, the term of this patent is extended or adjusted under 35 U.S.C. 154(b) by 150 days.

This patent is subject to a terminal disclaimer.

(21) Appl. No.: 16/989,476

(22) Filed: Aug. 10, 2020

Related U.S. Application Data

(63) Continuation-in-part of application No. 15/706,370, filed on Sep. 15, 2017, now Pat. No. 10,774,569.

(51) Int. Cl.

| | |
|---|---|
| ***E05B 19/00*** | (2006.01) |
| ***E05C 19/00*** | (2006.01) |
| ***G07C 9/00*** | (2020.01) |
| ***E05B 47/00*** | (2006.01) |
| *E05C 19/18* | (2006.01) |

(52) U.S. Cl.
CPC ..... *E05C 19/004* (2013.01); *E05B 47/0012* (2013.01); *G07C 9/00309* (2013.01); *E05Y 2900/132* (2013.01); *Y10S 292/25* (2013.01); *Y10T 292/65* (2015.04); *Y10T 292/67* (2015.04)

(58) Field of Classification Search
CPC ... Y10T 292/65; Y10T 292/67; E05C 19/003; E05C 19/004; E05C 19/005; Y10S 292/15; Y10S 292/25
See application file for complete search history.

(56) References Cited

U.S. PATENT DOCUMENTS

| | | | | |
|---|---|---|---|---|
| 1,481,501 | A | 1/1924 | Britten et al. | |
| 1,820,486 | A * | 8/1931 | Patrick | E05C 17/443 292/338 |
| 2,870,281 | A | 1/1959 | Mitchell | |
| 4,456,291 | A | 6/1984 | Brogie | |
| 4,883,297 | A | 11/1989 | Smith | |
| 5,098,138 | A | 3/1992 | Vandewege | |
| 5,787,548 | A | 8/1998 | Tzen | |
| 5,951,071 | A | 9/1999 | Elliott | |
| 7,021,683 | B2 | 4/2006 | Nissen | |
| 7,164,356 | B1 | 1/2007 | Zeitz | |
| 8,752,870 | B2 | 6/2014 | Wolf | |
| 10,774,569 | B1 * | 9/2020 | Edwards | E05C 19/004 |
| 2015/0101369 | A1 | 4/2015 | Scalisi | |
| 2016/0186470 | A1 | 6/2016 | Finley | |
| 2018/0148960 | A1 | 5/2018 | Finley | |

FOREIGN PATENT DOCUMENTS

| | | | |
|---|---|---|---|
| DE | 2611657 | | 10/1976 |
| DE | 102019008739 | A1 * | 6/2021 |
| FR | 341363 | | 8/1904 |

* cited by examiner

*Primary Examiner* — Carlos Lugo
(74) *Attorney, Agent, or Firm* — Hawley Troxell Ennis & Hawley LLP; Rivkah Young; Philip McKay

(57) ABSTRACT

Embodiments discussed herein enable an authorized user of a door security device to secure a door against entry, but also enable that authorized user to provide access to others, without having to provide a physical key. Embodiments discussed herein further allow an authorized user to operate the door security device remotely, such as through a wired or wireless network, or through any other network as described herein, as known at the time of filing, and/or as developed after the time of filing.

16 Claims, 6 Drawing Sheets

DOOR SECURITY DEVICE

RELATED APPLICATIONS

This application is a continuation-in-part of Edwards, U.S. patent application Ser. No. 15/706,370 (ELED001), filed on Sep. 15, 2017, entitled "DOOR SECURITY DEVICE," which is hereby incorporated by reference in its entirety as if it were fully set forth herein.

BACKGROUND

In everyday life, doors and doorways are ubiquitous. They are constructed in all shapes and sizes, from the very small to the very large.

An entry door of a structure, such as an office building, a home, or other structure, may control entry from an area outside of the structure into the interior of the structure. Sometimes, a door will be positioned between one interior point in a structure, such as a hallway, and a second area within the structure, such as a bedroom or other type of room. A business may have a structure where many office people work where a room is designated for a manager or an accountant. It may be desirable to protect sensitive information within that room from others, and a locking door knob is often installed on the door to prevent entry by the general public. In a home, for example, a door may be disposed between a hallway of the home and a room occupied by children.

Typically, a doorframe is constructed so that a closed door will be resting next to or against a door jam or door stop. The general function of the door jam or door stop in this example is to prevent a door from becoming overextended against the hinges. Overextension would put stress on the hinges of the door and might cause permanent damage, depending on the degree of overextension.

One commonality for many doors is that they are hinged on one edge, a right side edge, for example, and have a door latching mechanism, e.g. a doorknob coupled to a latch, on a different edge, such as a left edge. Correspondingly, a door may instead be hinged on an edge of the left side and have a door latching mechanism on an edge of the right side.

Door latching mechanisms come in a wide variety of shapes and capability, but typically serve to latch the door closed when desired. Additionally, some door latching mechanisms provide an additional locking feature allowing a user of the door latching mechanism to secure the door against use by an unauthorized person. Typically, a key is provided with such a door latching mechanism which is used by a user to physically unlock the door latching mechanism, thus allowing use of a door knob on the door latching mechanism to unlatch and open the door.

Prior art locking door latching mechanisms are useful for their intended purpose but the locking functionality of those prior art locking door latching mechanisms are easily defeated by nefarious persons, such as thieves or other persons that a property owner may want to keep out of an area protected by the door latching mechanism. It is fairly easy to acquire the tools and learn how to pick, e.g. unlock, various locks without having to use a key to unlock the door latching mechanism.

Further, prior art locking door latching mechanisms typically require a person to have a key and be present at the door latching mechanism in order to unlock and open the door. Thus, using those prior art locking door latching mechanisms, an owner or other person in authority must provide a key to another person who needs access, thus requiring that the key somehow be provided to the person needing access. Finally, the person needing access or any other person having a key might unintentionally lose the key, thus allowing others who find the key to gain access to areas protected by the prior art locking door latching mechanisms.

Therefore, what is needed is a new door security device which can secure a door against use by unauthorized persons.

SUMMARY

Embodiments of the present disclosure provide a solution to the problems discussed herein, and thus solve some of the shortcomings associated with prior art doors and locking door latching mechanisms. Embodiments discussed herein enable an authorized user of a door security device to secure a door against entry, but also enable that authorized user to provide access to others, without having to provide a physical key. Embodiments discussed herein further allow an authorized user to operate the door security device remotely, such as through a wired or wireless network, or through any other network as described herein, as known at the time of filing, and/or as developed after the time of filing.

In one embodiment, a door security device includes a vertical support member having a top end and a bottom end and an angular displacement area, the top end being coupled to a door. The coupling location can be any location above the floor, including at a door knob area. In one embodiment, if the top end of the vertical support member is coupled to the door at or adjacent to the door knob, the top end of the vertical support member is installed between the door knob and the door, thus robustly securing the top end of the vertical support member to the door. In one embodiment, the top end of the vertical support member is coupled to the door below the door knob, and is coupled directly to the door using a secure coupling mechanism such as nails, screws, rivets or other secure coupling mechanisms described herein, as known at the time of filing, and/or as developed after the time of filing.

In one embodiment, the door security device further includes a movable floor pressure member having a top location movably coupled to a location of the vertical support member, where the location is defined by a first distance from the top end of the vertical support member. In one embodiment, the first distance is between ½ inch and 24 inches from the top end of the vertical support member.

In one embodiment, the door security device further includes a locking system coupled to the vertical support member and the movable floor pressure member. In one embodiment, the locking system is configured with a locking action which, when triggered by a switch, is configured to convert the door security device from an unlocked configuration to a locked configuration, the conversion including moving the movable floor pressure member into an angled position with respect to the vertical support member, the angled position dictated, at least in part, by the angular displacement area. In one embodiment, the angular displacement area may be modified or removed, and/or the functionality of the angular displacement area may be disabled such that the conversion of the door security device from an unlocked to a locked configuration includes moving the movable floor pressure member vertically downwards, at no angle, and thus the movable floor pressure member may remain parallel to the vertical support member in both the unlocked and locked configurations.

In one embodiment, the movement of the movable floor pressure member causes a lower end of the movable floor pressure member to firmly engage a firm surface, such as the ground, a surface laying on top of the ground, a floor, etc., to put pressure on that surface with respect to the door, thus ensuring that the door cannot be opened. In one embodiment, the locking system is further configured to reverse the locking action, thus putting the door locking device into an unlocked position and allowing the door to be opened.

In one embodiment, the top location of the movable floor pressure member, where the movable floor pressure member is coupled to a location of the vertical support member, is a top end of the movable floor pressure member. In one embodiment, the top end of the movable floor pressure member is coupled to the vertical support member so that the movable floor pressure member is able to move to an angled position with respect to the vertical support member. In one embodiment, the top end of the movable floor pressure member is coupled to the vertical support member so that the movable floor pressure member is able to move vertically up and down, at no angle, thus remaining parallel to the vertical support member.

In one embodiment, the locking system further includes a process wherein, when the movable floor pressure member moves into the angled or downward vertical position with respect to the vertical support member, the top location of the movable floor pressure member moves at least towards the bottom end of the vertical support member. In one embodiment, the movable floor pressure member includes multiple pieces, for example, where the movable floor pressure member has a stable arm that moves angularly or vertically with respect to the vertical support member, with a second piece that is an extension arm that is configured to telescope and thus extend from within the movable floor pressure member towards the firm surface to ensure that a firm pressure is applied angularly or vertically between the door and the firm surface to lock the door into place.

In one embodiment, the locking system includes a motor coupled to the switch and the movable floor pressure member, wherein upon engagement of the switch when the door security device is in the unlocked configuration, the motor serves to move the movable floor pressure member from a vertical position with respect to the vertical support member to the previously described angled position. In one embodiment, the motor serves to move the movable floor pressure member from a first vertical position with respect to the vertical support member to a second vertical position with respect to the vertical support member. In one embodiment, the motor is coupled to a rotatable threaded shaft which is coupled to the movable floor pressure member, wherein upon engagement of the switch when the door security device is in the unlocked configuration, the motor rotates the shaft to move the movable floor pressure member from a first vertical position with respect to the vertical support member to the previously described angled position or to a second vertical position with respect to the vertical support member.

In one embodiment, the motor of the door security device is mounted on or within at least a portion of the vertical support member.

In one embodiment, the door security device includes the motor coupled to the movable floor pressure member through a threaded member coupled to the motor through a threaded shaft, the threaded member hingedly coupled to the movable floor pressure member. In one embodiment, when the switch is triggered at a time when the door security device is in an unlocked position, the motor rotates the threaded shaft, thus pulling the threaded member from a first position away from the motor to a second position closer to the motor, causing a pin of the movable floor pressure member to ride on the angular displacement area, causing the movable floor pressure member to move to the angled position with respect to the vertical support member. In one embodiment, the angular displacement area may be modified or removed, and/or the functionality of the angular displacement area may be disabled such that the conversion of the door security device from an unlocked to a locked configuration includes moving the movable floor pressure member vertically downwards.

In various embodiments, the movable floor pressure member is moved via a mechanism other than a threaded member coupled to an electric motor. For example, in one embodiment, a non-threaded member may be coupled to a hydraulic motor to accomplish the same functionality. In addition to electrical and hydraulic systems, the mechanism for moving the floor pressure member may include any suitable mechanism as currently known or as developed after the time of filing.

In one embodiment, the door security device includes at least a toggle switch operated manually to engage the motor to convert the door security device from an unlocked position to a locked position. In one embodiment, the door security device includes at least a toggle switch operated manually to engage the motor to convert the door security device from a locked position to an unlocked position.

In one embodiment, a switch of the door security device includes a remote engagement capability, wherein an unlocking command issued from a remote device coupled to the remote engagement capability triggers the door security device to convert from a locked configuration to an unlocked configuration. In one embodiment, the remote device is a mobile computing system. In one embodiment, the mobile computing system is a smartphone.

In one embodiment, a switch of the door security device includes a remote engagement capability, wherein a locking command issued from a device coupled to the remote engagement capability triggers the door security device to convert from an unlocked configuration to a locked configuration.

In one embodiment, a switch of the door security device includes a remote engagement capability, wherein a command issued from a device coupled to the remote engagement capability triggers the door security device to convert from a first configuration to a second configuration, wherein if the first configuration is an unlocked configuration then the second configuration is a locked configuration, and wherein if the first configuration is a locked configuration then the second configuration is an unlocked configuration.

In one embodiment, the remote engagement capability of the door security device includes wireless functionality and is coupled to the remote device using that wireless functionality. In one embodiment, the remote engagement capability of the door security device includes wireless functionality employing Bluetooth functionality and is coupled to the remote device using Bluetooth functionality.

In one embodiment, the remote engagement capability of the door security device includes wireless functionality and is coupled to the remote device using the internet.

In one embodiment, the remote engagement capability includes at least two different forms of wireless functionality, wherein a first wireless functionality is used by the device to perform one or more of configuring the door security device to set up authorized users, locking or unlocking the door security device, enabling or disabling internet users, enabling or disabling wireless users, and receiving new user data and activate new users. In one embodiment, the remote device communicates with the door security device through an application program installed on the remote device.

In one embodiment, the application program is configured to alternatively perform at least two different sets of process operations based on how the remote device is coupled to the door security device.

In one embodiment, the application program on the remote device is configured to perform at least two different sets of process operations, wherein a first set of process operations includes at least one process operation that may only be performed if the remote device is coupled to the door security device through near-field communication.

In one embodiment, the application program on the remote device is configured to perform at least two different sets of process operations, wherein a first set of process operations includes at least one process operation that may only be performed if the remote device is coupled to the door security device through wired communication.

In one embodiment, the application program on the remote device is configured to perform at least two different sets of process operations, wherein a first set of process operations includes at least one process operation that may only be performed if the remote device is coupled to the door security device through internet communication.

In one embodiment, the application program is configured to only authorize the performance of one or more restricted commands if the one or more restricted commands are triggered while an authorized user is logged into the door security device.

In one embodiment, the application program is configured to only authorize the performance of one or more restricted commands if the one or more restricted commands are triggered while an authorized user is logged into the door security device through near-field communication.

Figure 1A:
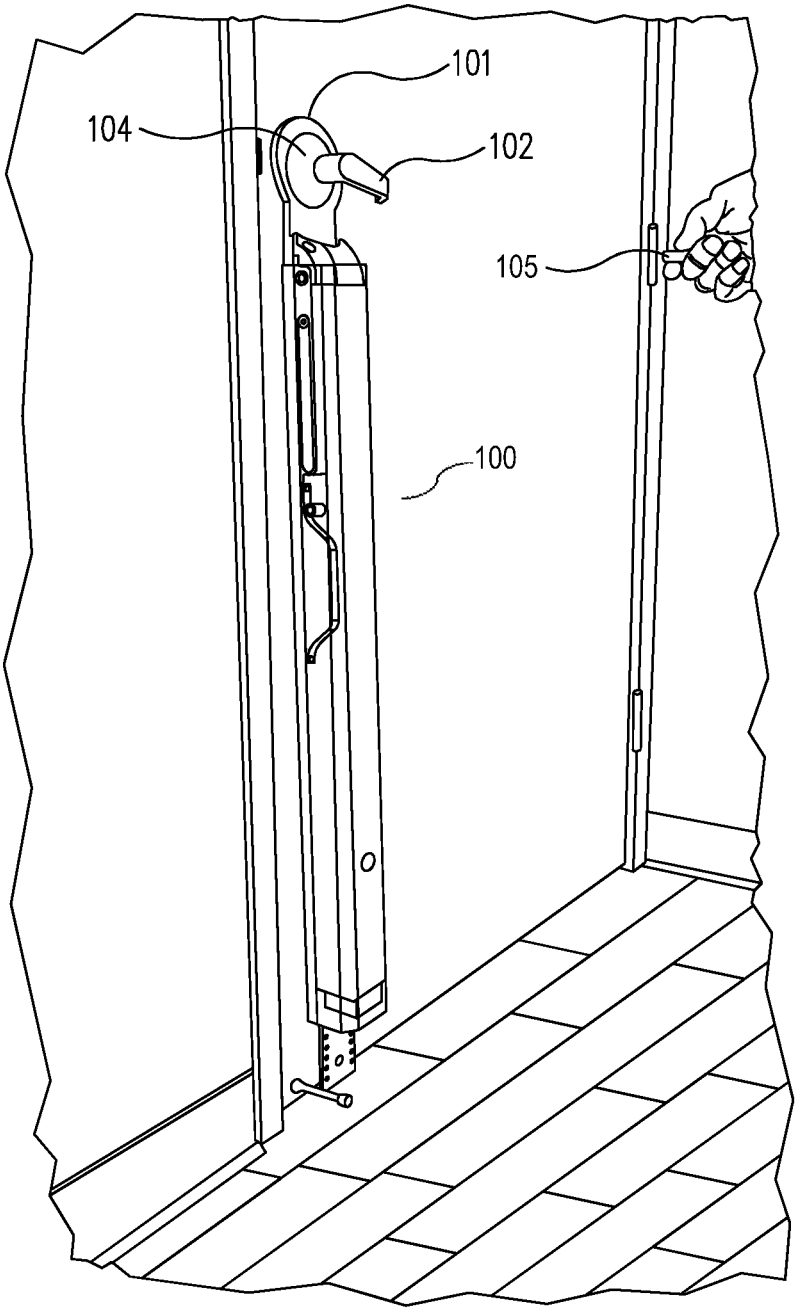
FIGS. 1A, 1B and 1C are system diagrams showing one embodiment of the door security device in operation.

Common reference numerals are used throughout the figures and the detailed description to indicate like elements. One skilled in the art will readily recognize that the above figures are examples and that other architectures, modes of operation, orders of operation, and elements/functions can be provided and implemented without departing from the characteristics and features of the invention, as set forth in the claims.

DETAILED DESCRIPTION

Embodiments will now be discussed with reference to the accompanying figures, which depict one or more exemplary embodiments. Embodiments may be implemented in many different forms and should not be construed as limited to the embodiments set forth herein, shown in the figures, and/or described below. Rather, these exemplary embodiments are provided to allow a complete disclosure that conveys the principles of the invention, as set forth in the claims, to those of skill in the art.

As discussed above, prior art locking door latching mechanisms are useful for their intended purpose but the locking functionality of those prior art locking door latching mechanisms are easily be defeated by nefarious persons, such as thieves or other persons that a property owner may want to keep out of an area protected by the door latching mechanism. It is fairly easy to acquire the tools and learn how to pick, e.g. unlock, various locks without having to use a key to unlock the door latching mechanism.

Further, prior art locking door latching mechanisms typically require a person to have a key and be present at the door latching mechanism in order to unlock and open the door. Thus, using those prior art locking door latching mechanisms, an owner or other person in authority must provide a key to another person who needs access, thus requiring that the key somehow be provided to the person needing access. Finally, the person needing access or any other person having a key might unintentionally lose the key, thus allowing others who find the key to gain access to areas protected by the prior art locking door latching mechanisms.

Those and other longstanding problems found in the field of securing doors are solved in an ingenious manner by the embodiments discussed herein.

Embodiments discussed herein enable an authorized user of a door security device to secure a door against entry, but also enable that authorized user to provide access to others, without having to provide a physical key. Embodiments discussed herein further allow an authorized user to operate the door security device remotely, such as through a wired or wireless network, or through any other network as described herein, as known at the time of filing, and/or as developed after the time of filing.

Figure 1B:
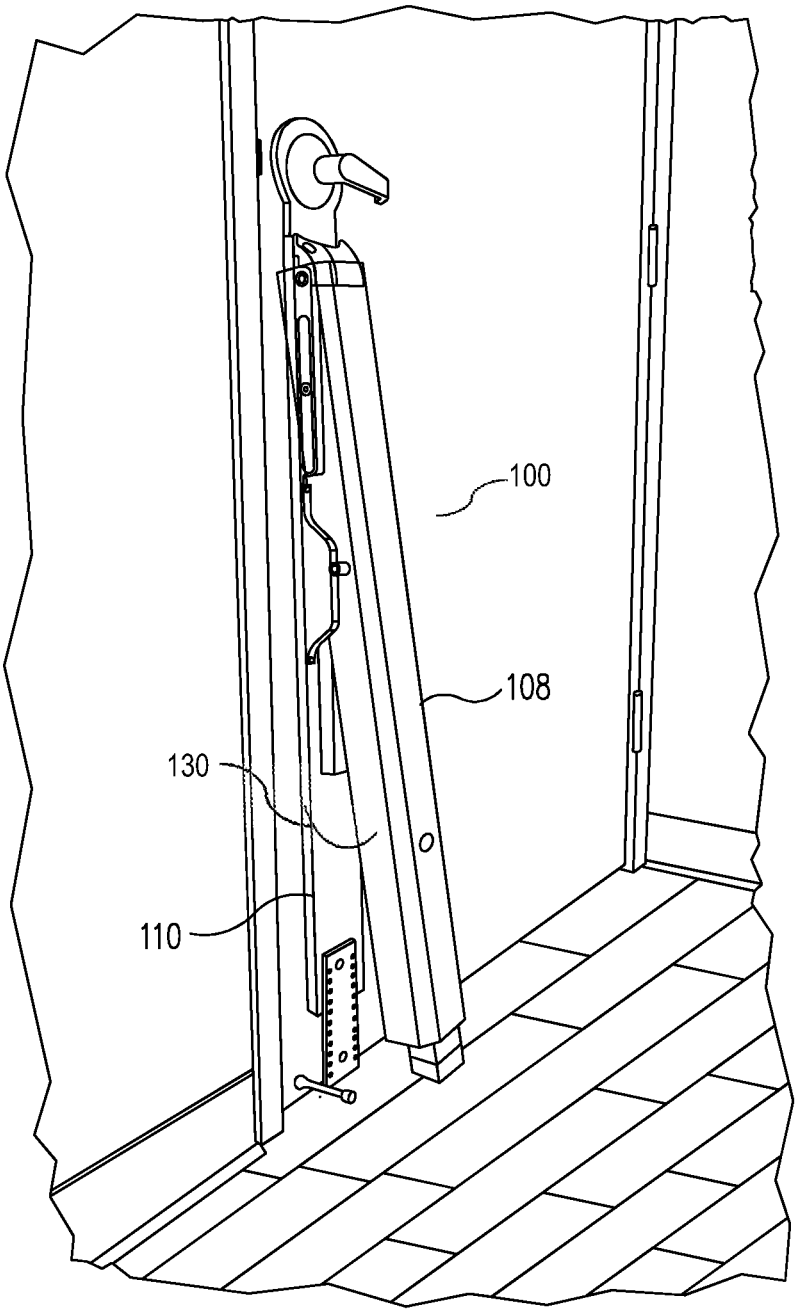
Figure 1C:
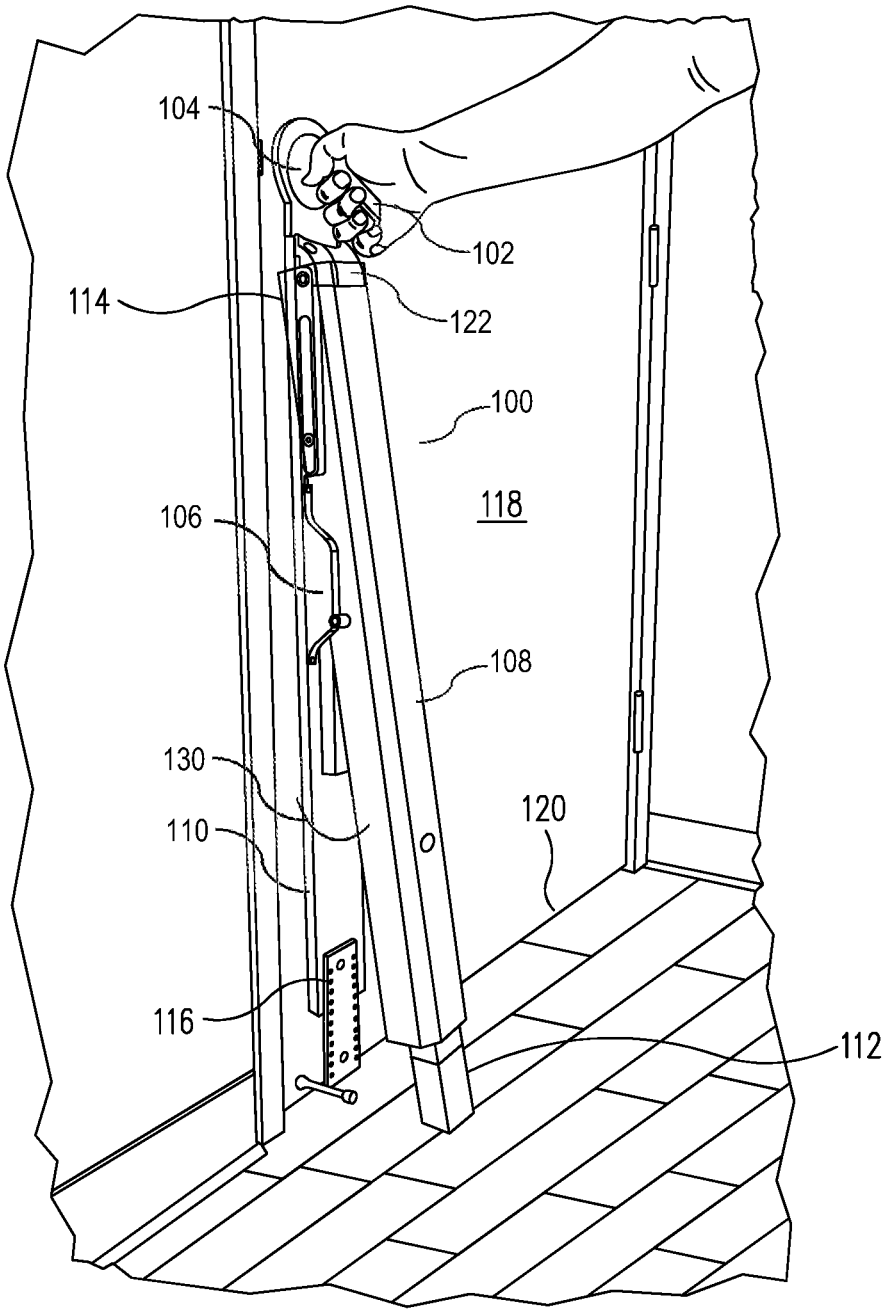

FIGS. 1A, 1B and 1C are system diagrams showing one embodiment of the door security device in operation.

Referring to FIGS. 1A, 1B and 1C together, a top end 101 of door security device 100 is shown coupled to or otherwise attached to a door knob 102 of a door latching mechanism 104. In this embodiment, door security device 100 is first shown in FIG. 1A in a fully-stowed, unlocked configuration where the various major components are relatively close to the door. Also shown in FIG. 1A is a user using a wireless device 105 to activate door security device 100 to change the configuration of door security device 100 from an unlocked or unsecure configuration to a locked or deployed configuration.

In FIG. 1B, door security device 100 is shown with a movable floor pressure member 108 (shown here with a cover) having been positioned during the configuration change process at an angle with respect to vertical support member 110. More details on the mechanisms involved in the configuration change will be discussed below.

In FIG. 1C, movable floor pressure member 108 has been extended at an angle 130 with respect to vertical support member 110 so a lower end 112 of movable floor pressure member 108 is firmly grounded to a firm surface, e.g. the floor. Thus, in the deployed, locking configuration, door security device 100 puts pressure between the floor and a location below door latching mechanism 104 of the door, such as door knob 102. In one embodiment, door security device 100 includes vertical support member 110 having a top end 114 and a bottom end 116 and an angular displacement area 106, top end 114 being coupled to a door 118. The coupling location can be any location above the floor, including at a door knob area. In one embodiment, the coupling location is between two to four feet up from the base 120 of the door. In one embodiment, if top end 114 of the vertical support member 110 is coupled to the door at or adjacent to door knob 102, top end 114 of vertical support member 110 is installed between door knob 102 and door 118, thus robustly securing top end 114 of vertical support member 110 to door 118. In one embodiment, top end 114 of vertical support member 110 is coupled to the door below door knob 102, and is coupled directly to door 118 using a secure coupling mechanism such as nails, screws, rivets or other secure coupling mechanisms described herein, as known at the time of filing, and/or as developed after the time of filing.

In one embodiment, door security device 100 is removable from door 118, through removing door knob 102, through removing door latching mechanism 104, through removing one or more nails, screws, rivets or other secure coupling mechanisms. In one embodiment, door security device 100 is built into door 118, and thus is not easily removable from door 118 without at least partially destructing door 118.

As explained herein, in one embodiment, door security device 100 includes a movable floor pressure member 108 having a top location 122 movably coupled to a location of vertical support member 110, where the location is defined by a first distance from the top end of vertical support member 110. In one embodiment, the first distance is between ½ inch and 24 inches from top end 114 of vertical support member 110.

Figure 1D:
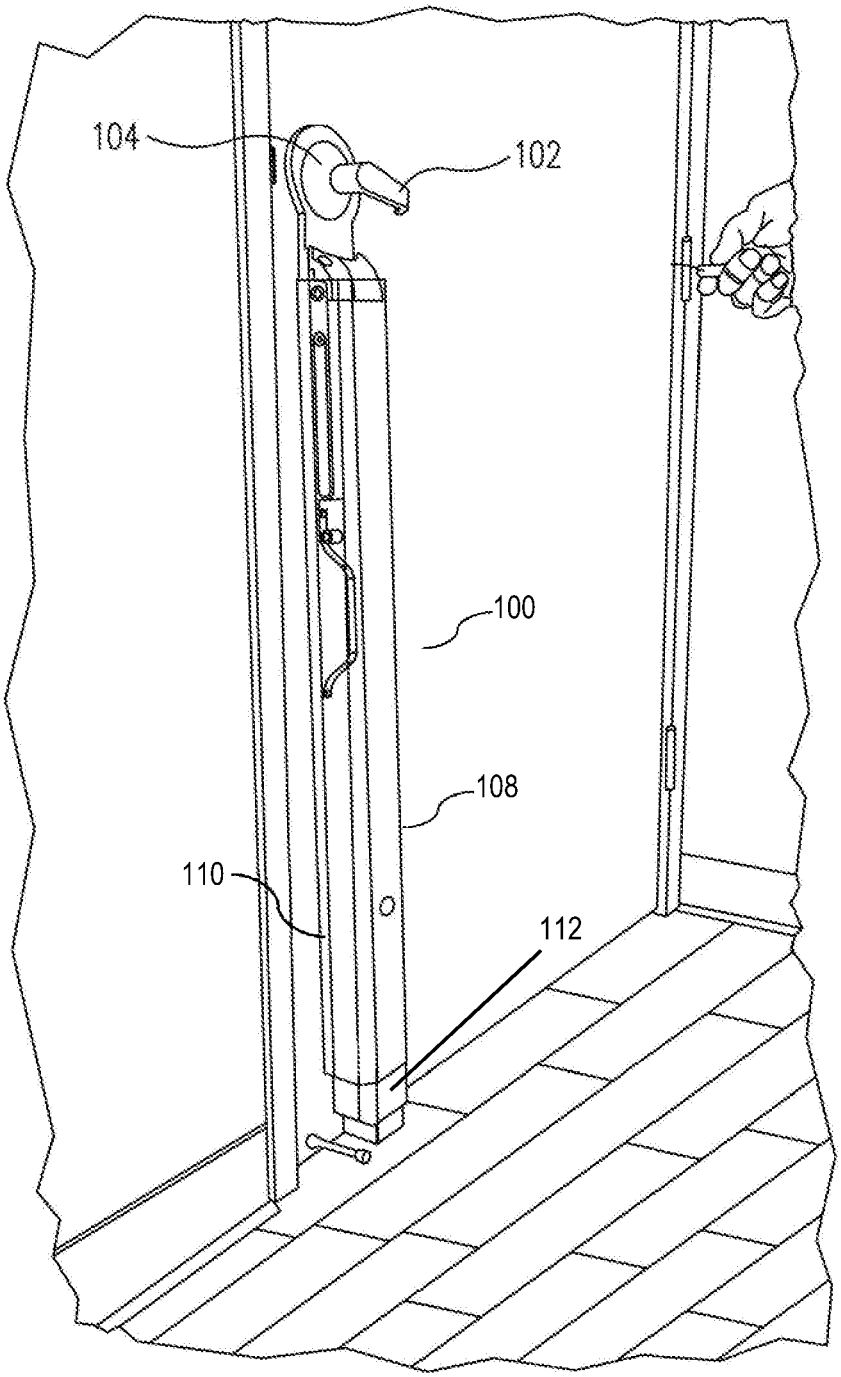
FIG. 1D is a system diagram showing an alternative embodiment of the door security device in a locked configuration.

FIG. 1D is a system diagram showing an alternative embodiment of door security device 100 in a locked configuration.

Referring now to FIGS. 1A, 1B, 1C, and 1D together, FIG. 1A shows door security device 100 in an unlocked configuration, in accordance with one embodiment. In some embodiments, during the configuration change from an unlocked to a locked configuration, movable floor pressure member 108 extends at an angle 130 away from vertical support member 110, as shown in FIG. 1B, which results in the locked configuration shown in FIG. 1C.

In contrast, in other embodiments, the configuration change includes a change from the unlocked configuration shown in FIG. 1A, to the alternative locked configuration shown in FIG. 1D. As shown in FIG. 1D, in this embodiment, movable floor pressure member 108 has not been extended at an angle 130, but has instead been extended vertically with respect to vertical support member 110, at no angle, so a lower end 112 of movable floor pressure member 108 is firmly grounded to a firm surface, e.g. the floor. Thus, in the deployed, locking configuration of FIG. 1D, door security device 100 puts pressure between the floor and a location below door latching mechanism 104 of the door, such as door knob 102.

Further details will be provided in conjunction with an exploded view of various component parts of door security device 100, according to one embodiment.

Figure 2A:
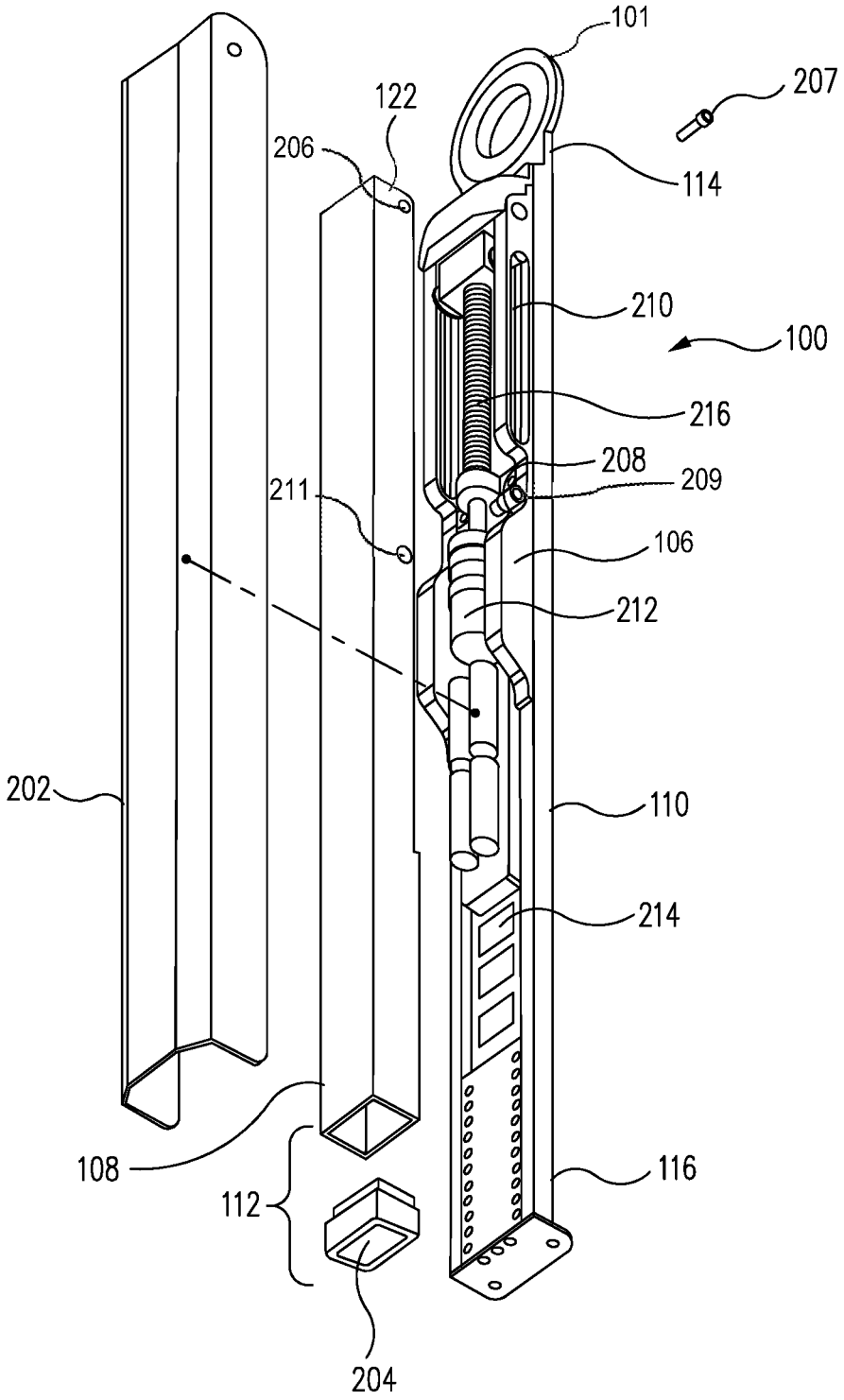
FIG. 2A is an exploded system diagram showing the door security device in accordance with a first embodiment.

FIG. 2A is an exploded system diagram showing door security device 100 in accordance with a first embodiment.

Referring to FIG. 2A, with reference also to FIGS. 1A, 1B and 1C as needed, door security device 100 includes, in one embodiment, a cover 202 which serves to mostly provide protection of components of door security device 100 from external elements, such as a person bumping into door security device 100, moisture, dirt, or other debris.

Also shown in FIG. 2A are a top end 101 of door security device 100 which is configured to be coupled to or otherwise attached to door knob 102 (FIG. 1) of a door latching mechanism 104 (FIG. 1).

Door security device 100 of FIG. 2A is shown including movable floor pressure member 108 having lower end 112 which optionally includes, according to one embodiment, a floor pressure pad 204 which, as configuration of door security device 100 shifts from an unlocked configuration to a locked configuration, comes into contact with a firm surface at or near the lower end 112 of movable floor pressure member 108.

In one embodiment, floor pressure pad 204 is removable. In one embodiment, floor pressure pad 204 is removable and is friction fit into a movable floor pressure member 108 assembly. In one embodiment, floor pressure pad 204 is built into an assembly including movable floor pressure member 108 so as not to be easily removed. Thus, floor pressure pad 204 may be manufactured into movable floor pressure member 108 as a single piece with floor pressure pad 204 glued or otherwise attached to movable floor pressure member 108.

In a deployed, locking configuration, door security device 100 puts pressure between a firm surface below door security device 100 and a location below door latching mechanism 104 of door 118, such as door knob 102, as shown in FIG. 1C and FIG. 1D.

As discussed above, door security device 100 includes vertical support member 110 having a top end 114 and a bottom end 116 and angular displacement area 106, top end 114 being coupled to a door.

In one embodiment, movable floor pressure member 108 is coupled to vertical support member 110 using hingepin 207 which engages with upper pin holes of moveable floor pressure member 108, such as upper hingepin hole 206, and passes through slidable channel 210. A lower guidepin 209 engages with lower pin holes of movable floor pressure member 108, such as lower guidepin hole 211. Lower guidepin 209 rides on a top surface 208 of angular displacement area 106 to provide, in one embodiment, angular displacement of movable floor pressure member 108 with respect to vertical support member 110.

In one embodiment, lower guidepin 209 may be removed, retracted, or repositioned such that no pin rides on top surface 208 of angular displacement area 106, thus allowing for non-angular movement of movable floor pressure member 108 from a first vertical position to a second vertical position. In one embodiment, angular displacement area 106 may be removed or otherwise modified, thus allowing for non-angular movement of movable floor pressure member 108 from a first vertical position to a second vertical position.

In practical operation, according to one embodiment, a user of door security device 100 triggers door security device 100 to change its current configuration. In one embodiment, the trigger causes door security device 100 to change configuration from an unlocked configuration to a locked configuration.

Thus, in practical operation, door security device 100 will begin, in this example, in a state or condition similar to that of FIG. 1A, with movable floor pressure member 108 roughly parallel with vertical support member 110 and not engaged with a firm surface, such as the ground. In this configuration, door 118 may be opened easily without specifically interacting with door security device 100.

In one embodiment, door security device 100 includes a switch which, when operated by a user of door security device 100, changes the configuration of door security device 100 from locked to unlocked, or from unlocked to locked. In various embodiments, intermediate configuration positions are also available, and contemplated to be within the scope of this disclosure. Such intermediate positions include, but are not limited to, an extended angular position where movable floor pressure member 108 is predeployed to an angular displacement position where an angle formed by the movable floor pressure member 108 with respect to vertical support member 110 is greater than 5 degrees, but less than 35 degrees.

In one embodiment, the switch is a toggle switch operated manually to engage motor 212 to convert door security device 100 from one configuration to another. In one embodiment, batteries supply power to door security device 100, including to motor 212. In one embodiment, rechargeable batteries are employed for power in door security device 100.

In one embodiment, a switch of door security device 100 includes a remote engagement capability 214, wherein an unlocking command issued from a remote device coupled to remote engagement capability 214 triggers door security device 100 to convert from a locked configuration to an unlocked configuration. In one embodiment, the remote device is a mobile computing system. In one embodiment, the mobile computing system is a smartphone.

In one embodiment, a switch of door security device 100 includes a remote engagement capability 214, wherein a locking command issued from a device coupled to the remote engagement capability 214 triggers door security device 100 to convert from an unlocked configuration to a locked configuration.

In one embodiment, a switch of door security device 100 includes remote engagement capability 214, wherein a command issued from a remote device coupled to remote engagement capability 214 triggers the door security device to convert from a first configuration to a second configuration, wherein if the first configuration is an unlocked configuration then the second configuration is a locked configuration, and wherein if the first configuration is a locked configuration then the second configuration is an unlocked configuration.

In one embodiment, remote engagement capability 214 of door security device 100 includes wireless functionality and is coupled to the remote device using that wireless functionality. In one embodiment, remote engagement capability 214 of door security device 100 includes wireless functionality employing bluetooth functionality and is coupled to the remote device using bluetooth functionality.

In one embodiment, remote engagement capability 214 of door security device 100 includes wireless functionality and is coupled to the remote device using the internet.

In one embodiment, remote engagement capability 214 includes at least two different forms of wireless functionality, wherein a first wireless functionality is used by the device to perform one or more of configuring the door security device to perform one or more process operations such as setting up one or more authorized users, locking or unlocking the door security device, enabling or disabling internet users, enabling or disabling wireless users, and receiving new user data and activating new users. In one embodiment, the remote device communicates with the door security device 100 through an application program installed on the remote device. In one embodiment, the application program of the remote device is configured to establish a secure communications pathway with door security device 100, through encryption of the data transitioning over the communications pathway between the remote device and door security device 100.

In one embodiment, the application program is configured to alternatively perform at least two different sets of process operations based on how the remote device is coupled to door security device 100.

In one embodiment, the application program on the remote device is configured to perform at least two different sets of process operations, wherein a first set of process operations includes at least one process operation that may only be performed if the remote device is coupled to door security device 100 through near-field communication.

For example, in one embodiment, if the remote device is coupled to door security device 100 using near-field communication, a first set of commands involving sensitive operations such as setting up new users, deleting old users, authorizing new devices, deleting old devices, and the like are able to be performed using near-field communication, but are disabled or are otherwise unable to be performed if the remote device is coupled to door security device 100 through the internet, or through any other communications pathway other than using near-field communication.

Correspondingly, in one embodiment, the application program on the remote device, and/or door security device itself, is configured to perform at least two different sets of process operations, wherein a first set of process operations includes at least one process operation that may only be performed if the remote device is coupled to door security device 100 through wired communication.

In one embodiment, the application program on the remote device is configured to at least two different sets of process operations, wherein a first set of process operations includes at least one process operation that may only be performed if the remote device is coupled to the door security device through internet communication. For example, in one embodiment, a command issued by one user authorizing a different user temporary permission to change the configuration of door security device 100 is only allowed to be performed when the remote device is communicating with door security device 100 through the internet.

In one embodiment, a command issued by one user authorizing a different user temporary permission to change the configuration of door security device 100 is only allowed to be performed when the remote device is communicating with door security device 100 through the internet using a secure, e.g. encrypted communication path.

In one embodiment, the application program is configured to only authorize the performance of one or more restricted commands if the one or more restricted commands are triggered while an authorized user is logged into door security device 100. In one embodiment, logging into door security device 100 employs at least a username and password combination to identify and otherwise validate that a predetermined authorized user is attempting to trigger door security device 100 to perform one or more commands. In one embodiment, a user and password combination is employed, but a third security measure, such as a computing system internet address is further used to validate whether a user attempting to issue commands to door security device 100 is an authorized user.

In one embodiment, the application program is configured to only authorize the performance of one or more restricted commands if the one or more restricted commands are triggered while an authorized user is logged into door security device 100 through near-field communication.

In one embodiment, door security device 100 further includes a locking system coupled to vertical support member 110 and movable floor pressure member 108. In one embodiment, the locking system is configured to perform a locking action which, when triggered by the switch, is configured to convert door security device 100 from an unlocked configuration, such as shown in FIG. 1A, to a locked configuration, such as shown in FIG. 1C, the conversion including motor 212 moving movable floor pressure member 108 into an angled position with respect to vertical support member 110, the angled position dictated, at least in part, by angular displacement area 106. In one embodiment, angular displacement area 106 may be modified or removed, and/or the functionality of angular displacement area 106 may be disabled, for example, by removing, retracting or repositioning lower guidepin 209 such that the conversion of door security device 100 from an unlocked configuration, such as shown in FIG. 1A, to a locked configuration, such as shown in FIG. 1D, includes moving movable floor pressure member 108 vertically downwards, at no angle, and thus movable floor pressure member 108 may remain parallel to vertical support member 110 in both the unlocked and locked configurations.

In the embodiment of FIG. 2A, in operation, during a change from an unlocked configuration, such as shown in FIG. 1A, to a locked configuration, such as shown in FIG. 1C, motor 212 rotates threaded shaft 216 thus pulling a top end 122 of movable floor pressure member 108 downward towards motor 212 along the path of slideable channel 210, while at the same time causing lower guidepin 209 to move over angular displacement area 106 of vertical support member 110, so that lower end 112 of movable floor pressure member 108 is pushed away from vertical support member 110. Because of the downward movement and the angular movement of lower end 112 of movable floor pressure member 108, movable floor pressure member 108 is positioned to present a firm pressure between the door and a firm surface in contact with floor pressure pad 204.

In one embodiment, the locking system is further configured to reverse the locking action, thus putting the door locking device into an unlocked position and allowing the door to be opened. During a change from a locked configuration, such as shown in FIG. 1C to an unlocked configuration, such as shown in FIG. 1A, motor 212 rotates threaded shaft 216 thus pushing top end 122 of movable floor pressure member 108 upwards away from motor 212 along the path of slideable channel 210, while at the same time causing lower guidepin 209 to move over angular displacement area 106 of vertical support member 110, so that lower end 112 of movable floor pressure member 108 is moved by gravity towards vertical support member 110. Because of the upward movement and the angular movement of lower end 112 of movable floor pressure member 108, movable floor pressure member 108 is positioned to minimize or remove any pressure between the door and the firm surface.

In one embodiment, the locking system further includes a process wherein, when the movable floor pressure member 108 moves into the angled position with respect to vertical support member 110, top location 122 of movable floor pressure member 108 moves at least towards bottom end 116 of vertical support member 110. In one embodiment, movable floor pressure member 108 includes multiple pieces, for example, where movable floor pressure member 108 has a stable arm that moves angularly with respect to the vertical support member, with a second piece that is an extension arm that is configured to telescope and thus extend from within movable floor pressure member 108 towards the firm surface to ensure that a firm pressure is applied angularly between the door and the firm surface to lock the door into place. In one embodiment, a pressure switch causes motor 212 to lose power following movable floor pressure member 108 providing a firm pressure against the firm surface, but is also configured to allow a reverse action to unlock door 118 at a later time, when desired.

In one embodiment, motor 212 of door security device 100 is mounted on or within at least a portion of vertical support member 110.

In one embodiment, angular displacement area 106 may be modified or removed, and/or the functionality of angular displacement area 106 may be disabled such that the conversion of door security device 100 from an unlocked configuration, such as shown in FIG. 1A, to a locked configuration, such as shown in FIG. 1D, includes moving movable floor pressure member 108 vertically downwards, at no angle, to provide a firm pressure against the firm surface. In one embodiment, the conversion of door security device 100 from a locked configuration, such as shown in FIG. 1D to an unlocked configuration, such as shown in FIG. 1A, includes moving movable floor pressure member 108 vertically upwards, at no angle, to minimize or remove any pressure between the door and the firm surface.

Figure 2B:
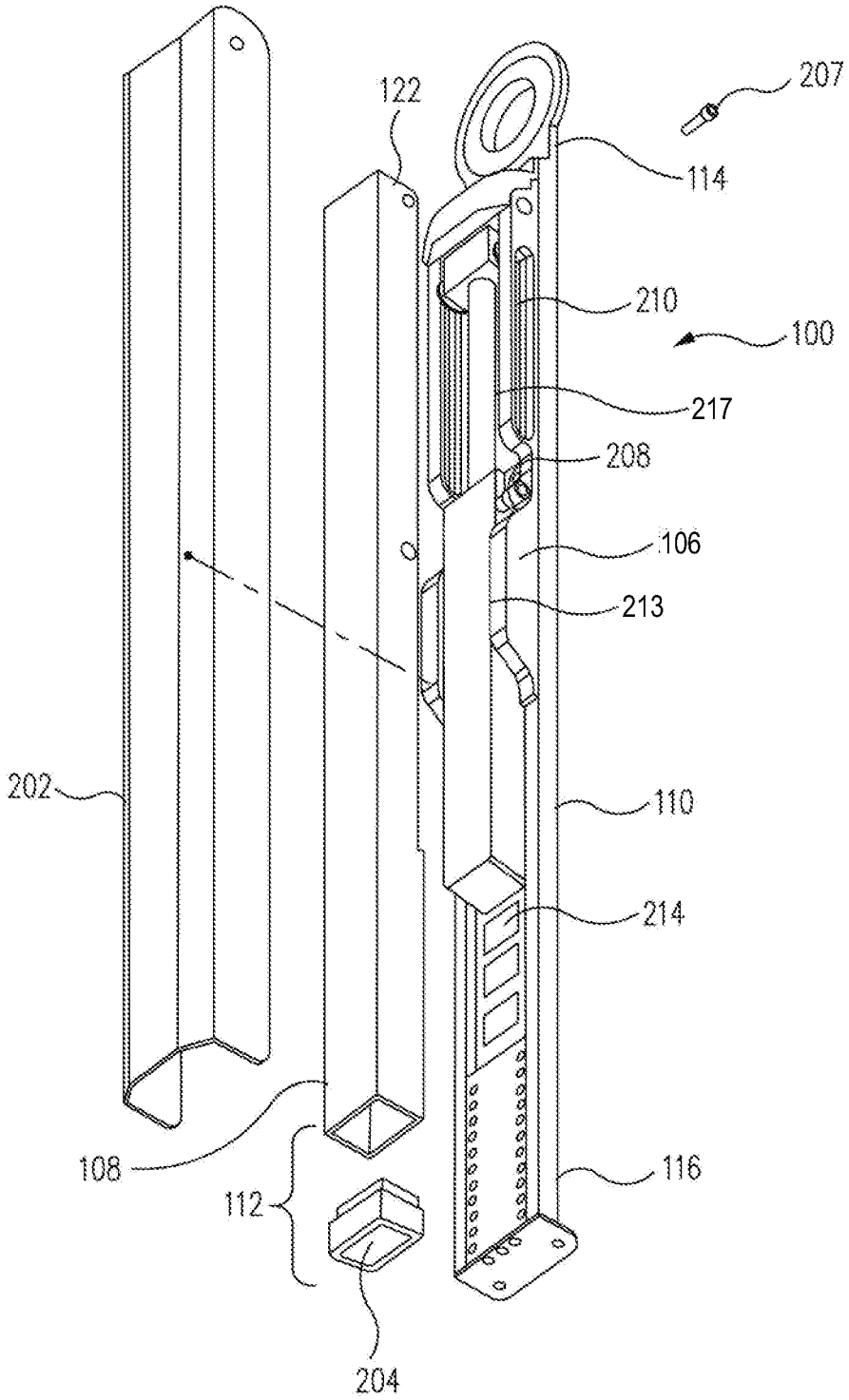
FIG. 2B is an exploded system diagram showing the door security device in accordance with a second embodiment.

FIG. 2B is an exploded system diagram showing door security device 100 in accordance with a second embodiment.

As shown in FIG. 2B, in various embodiments, movable floor pressure member 108 may be moved via a mechanism other than a threaded member coupled to an electric motor. For example, in one embodiment, non-threaded member 217 may be coupled to hydraulic motor 213 to accomplish the same functionality. In addition to electric and hydraulic systems, the mechanism for moving the floor pressure member from an unlocked to a locked configuration, or from a locked to an unlocked configuration, may include any suitable mechanism as currently known and/or as developed after the time of filing.

Thus, in one embodiment, the door security device comprises a vertical support member having a top end and a bottom end, the top end being coupled to a door. In one embodiment, the door security device further includes a movable floor pressure member having a top location coupled to a location of the vertical support member by a hingepin and a slidable channel of the vertical support member, where the location is defined by a first distance from the top end of the vertical support member. In one embodiment, the door security device further includes a motor mounted on the vertical support member, wherein the motor is coupled to a shaft, the shaft being hingedly coupled to the movable floor pressure member.

In one embodiment, the door security device further includes a switch, which when triggered at a time when the movable floor pressure member is retracted and the door security device is in an unlocked configuration, initiates an action to place the device in a locked configuration. In one embodiment, the action includes the motor pulling the shaft from a first position away from the motor to a second position closer to the motor, thus causing a lower end of the movable floor pressure member to extend and firmly engage a firm surface to put pressure on that surface with respect to the door, thus ensuring that the door cannot be opened. In one embodiment, when the switch is triggered at a time when the moveable floor pressure member is extended and the door security device is in a locked configuration, a reverse action is initiated to retract the moveable floor pressure member, wherein the motor pushes the shaft from a first position close to the motor to a second position away from the motor, thus putting the door security device into an unlocked configuration and allowing the door to be opened.

In another embodiment, the door security device comprises a vertical support member having a top end and a bottom end, and an angular displacement area, the top end being coupled to a door. In one embodiment, the door security device further includes a movable floor pressure member having a top location coupled to a location of the vertical support member by a hingepin and a slidable channel of the vertical support member, where the location is defined by a first distance from the top end of the vertical support member. In one embodiment, the door security device further includes a motor mounted on the vertical support member, wherein the motor is coupled to a shaft, the shaft being hingedly coupled to the movable floor pressure member. In one embodiment, the door security device further includes a lower guidepin, which rides on the angular displacement area of the vertical support member during movement of the shaft, causing the movable floor pressure member to move to an angled position with respect to the vertical support member, the angled position dictated, at least in part, by the angular displacement area;

In one embodiment, the door security device further includes a switch, which when triggered at a time when the movable floor pressure member is retracted and the door security device is in an unlocked configuration, initiates an action to place the device in a locked configuration. In one embodiment, the action includes the motor pulling the shaft from a first position away from the motor to a second position closer to the motor, thus causing a lower end of the movable floor pressure member to extend and firmly engage a firm surface to put pressure on that surface with respect to the door, thus ensuring that the door cannot be opened. In one embodiment, when the switch is triggered at a time when the moveable floor pressure member is extended and the door security device is in a locked configuration, a reverse action is initiated to retract the moveable floor pressure member, wherein the motor pushes the shaft from a first position close to the motor to a second position away from the motor, thus putting the door security device into an unlocked configuration and allowing the door to be opened.

In another embodiment, the door security device comprises a vertical support member having a top end and a bottom end, the top end being coupled to a door. In one embodiment, the door security device further includes a movable floor pressure member having a top location coupled to a location of the vertical support member by a hingepin and a slidable channel of the vertical support member, where the location is defined by a first distance from the top end of the vertical support member. In one embodiment, the door security device further includes a motor mounted on the vertical support member, wherein the motor is coupled to the movable floor pressure member through a threaded member coupled to the motor through a threaded shaft, the threaded member hingedly coupled to the movable floor pressure member;

In one embodiment, the door security device further includes a switch, which when triggered at a time when the movable floor pressure member is retracted and the door security device is in an unlocked configuration, initiates an action to place the device in a locked configuration. In one embodiment, the action includes the motor rotating the threaded shaft, pulling the threaded member from a first position away from the motor to a second position closer to the motor, thus causing a lower end of the movable floor pressure member to extend and firmly engage a firm surface to put pressure on that surface with respect to the door, thus ensuring that the door cannot be opened. In one embodiment, when the switch is triggered at a time when the moveable floor pressure member is extended and the door security device is in a locked configuration, a reverse action is initiated to retract the moveable floor pressure member, wherein the motor rotates the threaded shaft, pushing the threaded member from a first position close to the motor to a second position away from the motor, thus putting the door security device into an unlocked configuration and allowing the door to be opened.

In the discussion above, certain aspects of one embodiment include process steps and/or operations and/or instructions described herein for illustrative purposes in a particular order and/or grouping. However, the particular order and/or grouping shown and discussed herein are illustrative only and not limiting. Those of skill in the art will recognize that other orders and/or grouping of the process steps and/or operations and/or instructions are possible and, in some embodiments, one or more of the process steps and/or operations and/or instructions discussed above can be combined and/or deleted. In addition, portions of one or more of the process steps and/or operations and/or instructions can be re-grouped as portions of one or more other of the process steps and/or operations and/or instructions discussed herein. Consequently, the particular order and/or grouping of the process steps and/or operations and/or instructions discussed herein do not limit the scope of the invention as claimed below.

The present invention has been described in particular detail with respect to specific possible embodiments. Those of skill in the art will appreciate that the invention may be practiced in other embodiments. For example, the nomenclature used for components, capitalization of component designations and terms, the attributes, data structures, or any other programming or structural aspect is not significant, mandatory, or limiting, and the mechanisms that implement the invention or its features can have various different names, formats, or protocols. Further, the system or functionality of the invention may be implemented via various combinations of software and hardware, as described, or entirely in hardware elements. Also, particular divisions of functionality between the various components described herein are merely exemplary, and not mandatory or significant. Consequently, functions performed by a single component may, in other embodiments, be performed by multiple components, and functions performed by multiple components may, in other embodiments, be performed by a single component.

Some portions of the above description present the features of the present invention in terms of algorithms and symbolic representations of operations, or algorithm-like representations, of operations on information/data. These algorithmic or algorithm-like descriptions and representations are the means used by those of skill in the art to most effectively and efficiently convey the substance of their work to others of skill in the art. These operations, while described functionally or logically, are understood to be implemented by computer programs or computing systems. Furthermore, it has also proven convenient at times to refer to these arrangements of operations as steps or modules or by functional names, without loss of generality.

Unless specifically stated otherwise, as would be apparent from the above discussion, it is appreciated that throughout the above description, discussions utilizing terms such as, but not limited to, "activating", "accessing", "adding", "aggregating", "alerting", "applying", "analyzing", "associating", "calculating", "capturing", "categorizing", "classifying", "comparing", "creating", "defining", "detecting", "determining", "distributing", "eliminating", "encrypting", "extracting", "filtering", "forwarding", "generating", "identifying", "implementing", "informing", "monitoring", "obtaining", "posting", "processing", "providing", "receiving", "requesting", "saving", "sending", "storing", "substituting", "transferring", "transforming", "transmitting", "using", etc., refer to the action and process of a computing system or similar electronic device that manipulates and operates on data represented as physical (electronic) quantities within the computing system memories, resisters, caches or other information storage, transmission or display devices.

The present invention also relates to an apparatus or system for performing the operations described herein. This apparatus or system may be specifically constructed for the required purposes, or the apparatus or system can comprise a general purpose system selectively activated or configured/reconfigured by a computer program stored on a computer program product as discussed herein that can be accessed by a computing system or other device.

Those of skill in the art will readily recognize that the algorithms and operations presented herein are not inherently related to any particular computing system, computer architecture, computer or industry standard, or any other specific apparatus. Various general purpose systems may also be used with programs in accordance with the teaching herein, or it may prove more convenient/efficient to construct more specialized apparatuses to perform the required operations described herein. The required structure for a variety of these systems will be apparent to those of skill in the art, along with equivalent variations. In addition, the present invention is not described with reference to any particular programming language and it is appreciated that a variety of programming languages may be used to implement the teachings of the present invention as described herein, and any references to a specific language or languages are provided for illustrative purposes only and for enablement of the contemplated best mode of the invention at the time of filing.

It should also be noted that the language used in the specification has been principally selected for readability, clarity and instructional purposes, and may not have been selected to delineate or circumscribe the inventive subject matter. Accordingly, the disclosure of the present invention is intended to be illustrative, but not limiting, of the scope of the invention, which is set forth in the claims below.

In addition, the operations shown in the figures, or as discussed herein, are identified using a particular nomenclature for ease of description and understanding, but other nomenclature is often used in the art to identify equivalent operations.

Therefore, numerous variations, whether explicitly provided for by the specification or implied by the specification or not, may be implemented by one of skill in the art in view of this disclosure.

What is claimed is:

1. A door security device comprising:

a vertical support member having a top end and a bottom end and an angular displacement area, the top end being coupled to a door;

a movable floor pressure member having a top location coupled to a location of the vertical support member by a hingepin, one or more hingepin holes of the movable floor pressure member, and a slidable channel of the vertical support member, where the location of coupling is defined by a first distance from the top end of the vertical support member;

a motor mounted on the vertical support member, wherein the motor is coupled to a shaft such that the motor is able to initiate movement of the shaft;

a lower guidepin, which rides on the angular displacement area of the vertical support member during movement of the shaft, causing the movable floor pressure member to move to an angled position with respect to the vertical support member, the angled position dictated, at least in part, by the angular displacement area;

a switch, which when triggered at a time when the movable floor pressure member is retracted and the door security device is in an unlocked configuration, initiates an action to place the device in a locked configuration, wherein the motor pulls the shaft from a first position away from the motor to a second position closer to the motor, thus causing a lower end of the movable floor pressure member to extend and firmly engage a firm surface to put pressure on that surface with respect to the door, thus ensuring that the door cannot be opened, and further which when triggered at a time when the moveable floor pressure member is extended and the door security device is in a locked configuration, initiates a reverse action to retract the moveable floor pressure member, wherein the motor pushes the shaft from a first position close to the motor to a second position away from the motor, thus putting the door security device into an unlocked configuration and allowing the door to be opened.

2. The door security device of claim 1 wherein the top end is coupled to a door handle of the door.

3. The door security device of claim 2 wherein the top end is secured to the door handle through the top end being established between a portion of the door handle and the door.

4. The door security device of claim 1 wherein the switch includes at least a toggle switch operated manually to engage the motor to convert the door security device from an unlocked position to a locked position and to engage the motor to convert the door security device from a locked position to an unlocked position.

5. The door security device of claim 1 wherein the switch includes a remote engagement capability, wherein an unlocking command issued from a device coupled to the remote engagement capability triggers the door security device to convert from a locked configuration to an unlocked configuration.

6. The door security device of claim 1 wherein the switch includes a remote engagement capability, wherein a locking command issued from a device coupled to the remote engagement capability triggers the door security device to convert from an unlocked configuration to a locked configuration.

7. The door security device of claim 1 wherein the switch includes a remote engagement capability, wherein a command issued from a device coupled to the remote engagement capability triggers the door security device to convert from a first configuration to a second configuration, wherein if the first configuration is an unlocked configuration then the second configuration is a locked configuration, and wherein if the first configuration is a locked configuration then the second configuration is an unlocked configuration.

8. The door security device of claim 7 wherein the remote engagement capability includes wireless functionality and is coupled to the device through Bluetooth wireless functionality.

9. The door security device of claim 7 wherein the remote engagement capability includes wireless functionality and is coupled to the device through the internet.

10. The door security device of claim 7 wherein the remote engagement capability includes at least two different forms of wireless functionality, wherein a first wireless functionality is used by the device to perform one or more of:

configure the door security device to set up authorized users, lock or unlock the door security device, enable or disable internet users, enable or disable wireless users, and receive new user data and activate new users.

11. The door security device of claim 7 wherein the device communicates with the door security device through an application program installed on the device.

12. The door security device of claim 11 wherein the application program is configured to alternatively perform at least two different sets of process operations based on how the device is coupled to the door security device.

13. The door security device of claim 12 wherein the application program is configured to perform at least two different sets of process operations, wherein a first set of process operations may only be performed if the device is coupled to the door security device through near-field communication.

14. The door security device of claim 13 wherein the application program is configured to only authorize the performance of one or more restricted commands if the one or more restricted commands are triggered while an authorized user is logged into the door security device through near-field communication.

15. The door security device of claim 1 wherein the top location of the movable floor pressure member is a top end of the movable floor pressure member, further wherein when the movable floor pressure member moves into the angled position, the top location of the movable floor pressure member moves at least towards the bottom end of the vertical support member.

16. The door security device of claim 15 wherein the motor is coupled to the switch and the movable floor pressure member, and further wherein upon engagement of the switch when the door security device is in the unlocked configuration, the motor serves to move the movable floor pressure member from a vertical position with respect to the vertical support member to the angled position.

* * * * *